United States Patent [19]

Jones et al.

[11] 3,966,241

[45] June 29, 1976

[54] YARN KNOT

[75] Inventors: Charles Alonzo Jones; Jerry Joe Lawson; William Carl Mayrose, all of Shelby, N.C.

[73] Assignee: Fiber Industries, Inc., Charlotte, N.C.

[22] Filed: Apr. 15, 1974

[21] Appl. No.: 461,199

Related U.S. Application Data

[62] Division of Ser. No. 242,775, April 10, 1972.

[52] U.S. Cl. ..... 289/1.2

[51] Int. Cl.[2] ..... D04G 5/00

[58] Field of Search ..... 289/1.2, 1.5, 17, 18; 28/47, 49, 62, 71.3, 72 R, 48; 264/258; 57/34 R, 156, 158; 242/35.6 R, 37 A

[56] References Cited

UNITED STATES PATENTS

| | | | |
|---|---|---|---|
| 2,591,854 | 4/1952 | Nellis | 289/1.2 |
| 3,363,295 | 1/1968 | Allen | 28/72 R |
| 3,580,256 | 5/1971 | Wilkinson | 289/1.5 X |
| 3,857,231 | 12/1974 | Womer | 289/17 X |

*Primary Examiner*—Louis K. Rimrodt
*Attorney, Agent, or Firm*—Herbert M. Adrian, Jr.

[57] ABSTRACT

A filamentary yarn knot is described for use in creeling and transfer tailing yarns in a process which involves draw texturing. The yarns being creeled are undrawn or only partially drawn which are knotted together utilizing a balance knot. The yarn ends are first drawn prior to knotting the yarn so that the knot diameter is reduced to a diameter smaller than the diameter of the undrawn yarn and not greater than twice that of the drawn yarn.

4 Claims, 1 Drawing Figure

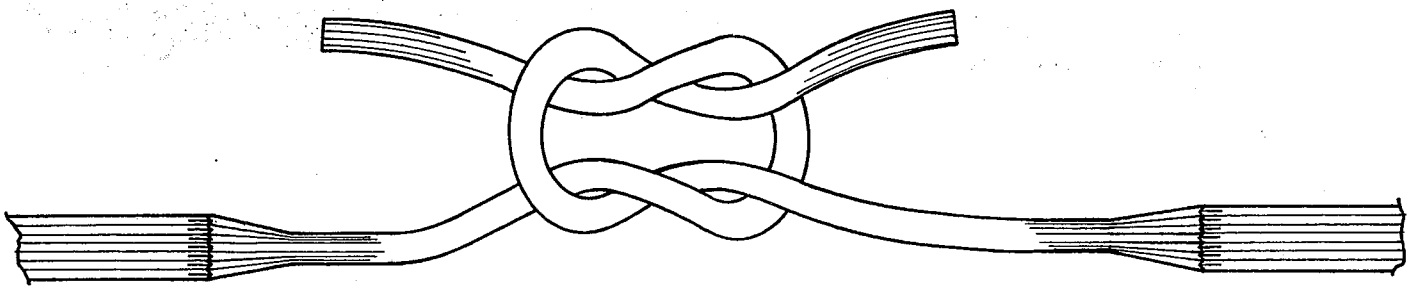

YARN KNOT

This is a of application Ser. No. 242,775, filed Apr. 10, 1972.

The present invention relates to a process for false twisting, including the false twisting of fully drawn yarn and draw-texturing of spun or partially drawn yarn (for example, as described in Belgian Pat. No. 728,461 or U.S. Pat. No. 3,601,972). The invention has special application to the area of draw-texturing.

More particularly, the present invention is directed to a method used to continuously supply underdrawn feed yarn to an integrated drawing and texturing operation.

Conventionally, a fiber producer spins a continuous filament yarn and then in a continuous or lagged operation therewith draws the yarn to a denier and tensile strength suitable for fabric construction. In a separate and distinct operation, the yarn is false twist crimped and then, where desired, overfed in continuous fashion while being subjected to heat and/or is heated in a separate operation after being wound loosely onto a package.

The present invention can be used when the yarn false twist crimping and yarn drawing operations are combined into a continuous process, simultaneous and/or sequential. Therefore, the invention is applicable to all variations of draw-texturing. For example, undrawn yarn of textile denier can be positively fed into a false twist zone consisting sequentially of a heater, a false twister and a draw roll, the latter operating at a speed sufficient to draw the yarn at the desired draw ratio. The false twist backs up into the heated zone through a draw neck point located therein, wherein twist is set into the yarn. The yarn is then sequentially, and in a continuous manner, overfed through a heated zone and packaged.

As a further example of draw-texturing, a snubbing pin or the like is placed upstream of the heater of the above-described apparatus sequence. In the latter case, the draw point is located by the snubbing action of the pin. Also, undrawn yarn can be continuously fed into a sequentially disposed apparatus by which the yarn is first drawn between feed and draw rolls, and is then continuously passed into a texturing zone. Again, the present invention can be usefully applied to all types of integrated draw-texturing process requiring underdrawn yarn (as-spun and/or partially drawn) as feed stock.

The stresses applied to the yarn during draw-texturing in the area of the yarn joint where the terminal portion of yarn from a first package is joined to the leading end of yarn from a second yarn package presented problems in the continuous operation of the draw-texturing process. Indeed, the problem begins with packaging of the as-spun yarn. Conventionally, the as-spun yarn is wound at constant speed onto a hard, surfacedriven yarn support. The innermost yarn layers will be compressed against the hard surface, which compression if not relieved in some manner, is believed to contribute to yarn non-uniformity problems. Within a short time period the as-spun yarn is draw twisted using a spindle-traveller-ring take-up. Often a programmed spindle speed tension process is used during draw twist packaging, e.g. increasing tension profile from inside to outside of package, to compensate for tension-related non-uniformities which might occur during conventional constant spindle speed winding. In this manner, the stresses on the yarn set up during as-spun yarn take-up are released before the yarn is textured. Otherwise, bulk variations, and ultimately dye uptake variations, are prone to occur.

For maximum productivity, the yarn texturer handling fully drawn yarn must run his texturing machines 24 hours a day. Because a pirn of drawn yarn will only last a certain number of hours, the texturer will creel two or more drawn yarn packages per texturing position and tie the "tail" or innermost end of yarn (often the yarn producer will wind the first short length of yarn on the pirn at a point to be spaced from the remainder of the packaged yarn) of the package feeding into the texturing machine to the outermost end of yarn on another feed yarn package. This procedure is repeated as long as the texturing position is running.

It was soon apparent that another method to relieve the stresses on the innermost layers of as-spun yarn had to be used because of the lack of rewinding prior to draw-texturing. Similarly, a modified transfer method had to be developed.

When as-spun yarn ends are tied together in a random fashion, tension imposed by draw-texturing often pulls the knot apart, or if the knot passes through texturing, it is unevenly drawn and produces a visible spot in constructed fabric and/or snags during knitting or weaving.

It has been found that the following process eliminates the problems heretofore expressed in the creeling and transferring of as-spun yarn concommitant to draw-texturing. It should be noted that the process is also applicable to the use of partially drawn feed yarn.

Applicants herein have discovered a process for continuously supplying underdrawn feed yarn (which in this context is inclusive of partially drawn yarn) to a false twist texturing machine operating continuously, and in simultaneous and/or sequential fashion, to draw and texture said feed yarn, which comprises winding the undrawn or partially drawn feed yarn onto a support suitable to serve as a feed yarn package for a draw and texturing apparatus while winding a short first tail of said yarn at a point on said support spaced from the surface area of the support onto which the remainder of the yarn of the package is to be wound; using a yarn support which is compressible at least along the support surface area onto which said balance of yarn is to be wound while of sufficient strength and constructional integrity to serve as a yarn package support; completing the winding of said yarn package; creeling at least two of said yarn packages for sequential feed one package after the other into a yarn draw and texturing apparatus; joining the end of the tail of the first yarn package to the leading end of the yarn of the second package so that there is substantially no undrawn yarn forming the yarn joint and there is substantially no drawn yarn outside of the yarn joint, the joint being able to withstand the draw and texturing process; positioning the joint in the center of the yarn bundle and repeating the tying process for each sequential package of yarn that is fed continuously into the same texturing zone.

It is recommended that the compressible yarn support surface be formed in one of three ways. First, the conventional, hard, rigid tube can be modified by altering its surface characteristics. For example, a thin layer of foam rubber or the like could be applied to the surface thereof prior to yarn packageing. Second, the yarn support can be formed of a material such as pressed paper or an elastomer which would inherently provide the compressibility and strength combination required. Third, and preferred, is that a small amount, for example to provide a 0.01 to 1.00 inch thick layer of yarn on the support, of the underdrawn yarn be wound onto the conventional yarn support tube to act as a cushion prior to formation of the spaced tail portion. In this manner the threadline is severed between the tail and yarn cushion at the time of joining the tail end of that package of yarn to the leading end of another package of yarn and the yarn cushion is discarded as waste.

Reference is made to the drawing which shows a preferred embodiment of the present invention as represented by a balanced knot, to wit, a square knot, wherein the ends of the yarn being joined have been drawn prior to knotting.

Considering yarn joining in greater detail, it is essential that the joint be formed of drawn yarn, but that drawn yarn is not found outside of the joint. This is because as-spun yarn in the joint does not provide sufficient friction within the joint to prevent the joint from being pulled apart during drawing. Any drawn yarn adjacent the joint, if exposed to drawing conditions, will be further drawn and have a different dye uptake property than the remainder of the drawn and textured yarn.

A self-tightening, balanced knot is preferred, for example a square knot. A balanced knot joining two yarn ends is a union of the two yarn ends by an intermingling of the yarn ends about each other to form a continuation of the yarns wherein approximately equal portions of intermingled yarn protrude from at least one imaginary straight plane running longitudinally through the yarns when held in straight, extended fashion, with the center line of said plane coinciding with the center of the yarns. More particularly, a balanced knot in a yarn is one which has about equal portions of the knot on a volume basis on both sides of at least one imaginary plane which bisects the knot and approximately coincides with the diameter of a sphere circumscribing the knot, with said diameter when extended, running parallel to and approximately through the center of the yarn bundles on both sides of the knot when both yarn bundles form segments of a straight line. A self-tightening knot is one which tightens when the yarn end (or ends) leading into the knot is tensioned in a direction so that the stress exerted reaches the knot.

The end portions of the yarn to be tied together can be drawn easily by pulling a fixed terminal portion of each yarn end to about the thickness of the drawn yarn product. The machine operator can repeatedly accomplish this step after some practice. It is not critical that the denier be exactly that of the drawn textured yarn product.

In order to ensure that there is an exact noticeable point along the yarn's length between drawn and undrawn yarn, a yarn holding device should be employed. By firmly clamping the yarn end in a vise, a protruding terminal portion can be elongated by hand up to the jaws of the vise and the draw neck will not pass beyond the clamped point of the yarn.

The joint is conveniently formed by hand tying a centrallylocated knot having a smaller diameter than the diameter of the undrawn yarn, and preferably a diameter not greater than twice that of the drawn yarn. A square knot is recommended. A reef knot can be employed. A surgeon's knot or a weaver's knot will often suffice but is not recommended. Of course, other types of yarn joints can be employed such as a thermal yarn joint formed by heating the yarn ends wrapped about each other. An air splice is not recommended because it is often of a loose, voluminous character with flaring filaments, which are undesirable herein. Other variations of the invention will be apparent to the artisan. The invention is applicable to the processing of man-made fibers, especially those of a synthetic nature, for example continuous filament yarn comprising polyester, nylon, acrylonitrile, blends thereof and the like of up to about 300 drawn denier.

What is claimed is:

1. A yarn knot composed of two leading ends of continuous filament substantially uniformly underdrawn yarn, said ends being knotted about each other to form a unitary continuing yarn, the portion of said ends engaged in said knotted manner being substantially drawn, and the successive portions of said ends immediately adjacent said knotted portion being substantially uniformly underdrawn wherein said knotting is constituted by a self-tightening, balanced knot.

2. The yarn knot of claim 1, wherein approximately equal portions of knotted yarns protrude from at least one imaginary straight plane running longitudinally through the yarns when held in straight, extended fashion, with the center line of said plane coinciding with the center of the yarns.

3. The yarn knot of claim 2, wherein said knot has about equal portions on a volume basis on both sides of at least one imaginary plane which bisects the knot and approximately coincides with the diameter of a sphere circumscribing the knot, with said diameter when extended, running parallel to and approximately through the center of the yarn bundles on both sides of the knot when both yarn bundles form segments of a straight line.

4. The yarn knot of claim 3, wherein said ends are constituted by polyester yarn of not greater than 170 denier and said knot is selected from the group consisting of a square knot and a reef knot.

* * * * *